United States Patent [19]

Bardenhagen et al.

[11] 4,278,385

[45] Jul. 14, 1981

[54] APPARATUS FOR TRANSFERRING CIGARETTES OR THE LIKE FROM TRAYS INTO MAGAZINES OF PACKING MACHINES OR THE LIKE

[75] Inventors: Dietrich Bardenhagen; Wolfgang Raschka; Josef Glösmann, all of Hamburg; Gerhard Tolasch, Wentorf, all of Fed. Rep. of Germany

[73] Assignee: Hauni-Werke Körber & Co. KG., Hamburg, Fed. Rep. of Germany

[21] Appl. No.: 88,473

[22] Filed: Oct. 26, 1979

[30] Foreign Application Priority Data

Oct. 30, 1978 [DE] Fed. Rep. of Germany ..... 2847131
May 3, 1979 [DE] Fed. Rep. of Germany ..... 2917818

[51] Int. Cl.[3] ..... B65B 19/02
[52] U.S. Cl. ..... 414/419
[58] Field of Search ..... 414/403, 414, 419, 420, 414/421

[56] References Cited

U.S. PATENT DOCUMENTS 3,486,647 12/1969 Seragnoli ..... 414/419 X
3,655,080 4/1972 Gianese ..... 414/403 X
3,703,242 11/1972 Marradi ..... 414/414
4,056,206 11/1977 Bennett ..... 414/419

FOREIGN PATENT DOCUMENTS 2018442 10/1971 Fed. Rep. of Germany .

*Primary Examiner*—Jeffrey V. Nase
*Attorney, Agent, or Firm*—Peter K. Kontler

[57] ABSTRACT

A holder which is turnable about a horizontal axis supports two carriers for filled or empty trays. The holder moves one carrier with a filled tray therein from a first station to a second station where the carrier deposits the filled tray, in inverted position, on top of the magazine of a packing machine, while the other carrier moves back from the second to the first station. The carriers are pivotable relative to the holder so that a carrier with a filled tray therein can descend on top of the magazine during the last stage of movement to the second station and that the carrier with an empty tray therein is lifted above the magazine during the initial stage of its movement from the second station. This is achieved by connecting the carriers to links which are pivoted directly to the holder or to a lever which is rotatable by a shaft eccentrically mounted in the interior of a hollow cylinder serving to turn the holder.

26 Claims, 14 Drawing Figures

M
PM

APPARATUS FOR TRANSFERRING CIGARETTES OR THE LIKE FROM TRAYS INTO MAGAZINES OF PACKING MACHINES OR THE LIKE

BACKGROUND OF THE INVENTION

The present invention relates to apparatus for transporting rod-shaped articles which constitute or form part of smokers' products. More particularly, the invention relates to improvements in apparatus for manipulating so-called chargers or trays which contain arrays of parallel plain or filter tipped cigarettes, cigars, cigarillos or cheroots, or arrays of parallel filter rod sections. Still more particularly, the invention relates to improvements in apparatus for delivering filled trays to and for removing empty trays from magazines of processing machines for rod-shaped articles which constitute or form part of smokers' products.

It is already known to insert filled trays into carriers which are thereupon inverted so as to allow the contents of filled trays to descend by gravity, e.g., into the magazine of a packing or other processing machine. In many instances, the carriers are disposed in pairs so that one thereof can store a filled tray and the other thereof can dispense the contents of a filled tray. The carriers are mounted on a common holder and are caused to move between a first station where the carriers are relieved of empty trays and receive filled trays and a second station where the contents of filled trays are dumped into the magazine of a consuming or processing machine, e.g., into the magazine of a packing machine.

Presently known chargers or trays are normally open at the front side and at the top so that they can be loaded by introducing rod-shaped articles through the front side and that, upon inversion, their contents can be evacuated through the open tops. The articles which leave an inverted tray by gravity descend onto the supply of articles which are already contained in the magazine of the processing machine (hereinafter called packer for short). The distance which the descending articles leaving the inverted tray should cover is relatively short; otherwise, the articles are likely to lose tobacco particles, to undergo deformation and/or to lie askew in the interior of the magazine. This can entail lengthy interruptions in the operation of a packer which is supposed to process many thousands of articles per minute, i.e., each and every (even very short) interruption of normal operation of the packer can entail enormous losses in output. For example, one or more filter plugs or filter cigarettes which lie askew are likely to interfere with proper descent of similar articles in the magazine, to interfere with proper evacuation of articles through the outlet of the magazine, to cause damage to and/or deformation of adjacent articles and/or other malfunctions and/or defects.

One of the solutions which are resorted to in presently known apparatus for transferring the contents of filled trays into the magazines of packers or the like is that the inverted tray is deposited immediately on top of the magazine, so that the distance between the lowermost layer or stratum of articles in the inverted tray and the uppermost layer or stratum of articles in the magazine is relatively short. Such solution is quite satisfactory if an empty tray can be lifted off the magazine within a short interval of time, so that the inlet of the magazine is immediately exposed for reception of articles through the inverted open top of a filled container. In the absence of such mode of operation, the level of articles in the magazine descends very rapidly during removal of an emptied tray and during subsequent placing of an inverted filled tray on top of the magazine. Therefore, when the filled tray comes to rest on the magazine and begins to discharge its contents by gravity, the articles which leave the tray must cover a considerable distance with the aforediscussed detrimental effect or effects. Therefore, the rate at which the packer processes the articles must be reduced in order to avoid misalignment of articles which descend from the interior of the inverted tray. In other words, the mechanism which transports filled trays to and removes empty trays from the magazine of a packer constitutes a bottleneck in the production line which normally includes one or more cigarette makers, one or more filter tipping machines, one or more filter rod making machines and one or more packers. As a rule, the carriers for trays are mounted on their holders for pivotal movement about horizontal or nearly horizontal axes. Therefore, any pivotal movement of a carrier which contains a freshly emptied tray must be preceded by at least some upward movement of such carrier in order to enable the freshly emptied tray to share the pivotal movement of its carrier without striking against the top of the magazine. The same holds true for the delivery of a filled tray; such tray must be pivoted with its carrier about a horizontal axis prior to slight or even pronounced downward movement to come to rest on top of the magazine in a packer or the like.

Certain types of presently known apparatus for the transport of filled and empty trays are disclosed, for example, in U.S. Pat. No. 3,655,080 to Gianese; in U.S. Pat. No. 4,056,206 to Bennett and in German Offenlegungsschrift No. 2,018,442. The patent to Gianese discloses an apparatus wherein a filled tray is lifted by an elevator to be introduced into a carrier which is thereupon inverted to place the tray therein on top of a magazine. The empty tray is extracted from the carrier and is delivered to a removing conveyor for transport to a discharge area. The patent to Bennett discloses two carriers which must be lifted prior to deposition of a full tray (in inverted condition) on top of a magazine. The German publication discloses an apparatus wherein the inverting device for filled trays occupies a relatively small space, as considered radially of the axis of rotation of the inverting device. This is achieved by appropriate selection of the positions of carriers for empty and filled trays with reference to the axis of rotation of the carriers. The German publication stresses the reduction in the mass of parts to be inverted; such reduction is attributed to greater compactness of the apparatus.

OBJECTS AND SUMMARY OF THE INVENTION

An object of the invention is to provide a novel and improved apparatus which can supply cigarettes or analogous rod-shaped articles to the magazine of a packing machine at a rate sufficiently high to meet the requirements of ultramodern high-speed machines.

Another object of the invention is to provide a simple, compact and rugged apparatus for transfer of the contents of cigarette trays or like containers into the magazine of a packing or other processing machine.

A further object of the invention is to provide an apparatus wherein the containers for rod-shaped articles are treated gently and which operates with minimal noise and without damaging or defacing the processing machine.

An additional object of the invention is to provide an apparatus which can be installed in or on or otherwise associated with existing machines for the processing of stacked or arrayed rod-shaped articles which constitute or form part of smokers' products.

Another object of the invention is to provide the apparatus with novel and improved means for mounting and moving the carriers for filled or empty chargers or trays for cigarettes or the like.

One feature of the invention resides in the provision of an apparatus for transporting filled trays from a first station to a second station at which a filled tray is located on top of a magazine and its contents are transferred into such magazine, and for thereupon transporting the thus obtained empty trays from the second station back to the first station. The apparatus comprises holder means which is turnable about a substantially horizontal axis, first and second carriers which are turnable with the holder means and each of which is arranged to accommodate a filled tray or an empty tray (depending upon whether the respective carrier moves toward or from the second station), means for turning the holder means about the horizontal axis to thereby invert that one of the carriers which moves with a filled tray from the first to the second station as well as to simultaneously return to non-inverted position the other carrier which moves with an empty tray from the second toward the first station, and means for pivoting the carriers relative to the holder means while the holder means turns to move the carriers between the two stations. The pivoting means includes link means which, in accordance with a first embodiment, articulately connects the carriers directly with the holder means. In accordance with a modification, the link means may connect those portions of the carriers which face the axis about which the holder means turns with a coupling member (e.g., a two-armed lever) mounted on a shaft whose axis is parallel to but does not coincide with the axis of rotation of the holder means.

The link means of the pivoting means is constructed, mounted and moved in such a way as to lower the filled tray in an inverted carrier on top of the magazine during the last stage of movement to the second station, and to lift such carrier (with the freshly emptied tray therein) off the top of the magazine during the initial stage of movement from the second station.

The apparatus preferably further comprises a device for reception of an empty tray from the carrier which arrives at the first station, and a device for delivery of a filled tray to the carrier at the first station. One of these devices (preferably the device for reception of empty trays) is disposed at a level above the other device, and each of these devices is preferably mounted at a level below the first station. The one device preferably includes a portion which is movable between a carrier at the first station and the other device so that it can be moved out of the way when a tray is transported from the other device to the carrier at the first station or vice versa.

If the link means couples the carriers to a lever which is turnable relative to the holder means for the carriers, the means for pivoting the carriers concomitantly with turning of the holder means (and resulting inversion of the carriers) may further comprise drive means for rotating the shaft for the lever, and the means for turning the holder means may comprise drive means for rotating a hollow cylinder which defines the aforementioned horizontal axis. Each of these drive means may comprise a continuously rotatable cam (e.g., a disc cam), means for rotating the cams, and a star wheel which is intermittently driven by the respective cam and transmits torque to the respective driven element (i.e., to the shaft for the lever and to the hollow cylinder of the shaft for the holder means).

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
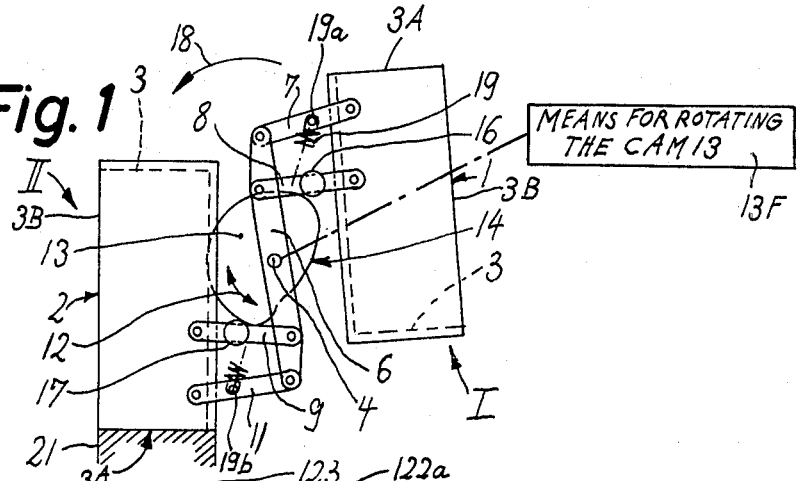
FIG. 1 is a schematic side elevational view of a portion of an apparatus which embodies one form of the invention, a filled tray being shown in a position it assumes while resting on top of a magazine.

The apparatus which is shown in FIG. 1 comprises two carriers 1 and 2 each of which can receive a container in the form of a charger or tray 3 for a stack of a parallel rod-shaped articles (e.g., filter cigarettes or filter rod sections) which constitute or form part of smokers' products. Each tray 3 has an open top 3A and an open front side 3B so that it can be filled with articles through the front side 3B and relieved of its contents through the top 3A when the respective carrier 1 or 2 is inverted to place a filled tray 3 on top of a magazine 21. The carriers 1 and 2 are attached to the respective end portions of a holder 6 which can comprise one or two two-armed levers turnable about the axis of a horizontal shaft 4 mounted in the frame (not shown) of the apparatus. The means for articulately connecting the carrier 1 to one end portion of the illustrated holder 6 comprises two links 7 and 8, and the means for articulately connecting the carrier 2 to the other end portion of the illustrated holder 6 comprises two links 9 and 11. The end portions of each link are pivotally secured to the corresponding carrier 1 or 2 as well as to the corresponding arm of the illustrated holder 6. If the apparatus comprises two holders 6 so that the carriers 1 and 2 are disposed between such holders, the apparatus also comprises two pairs of links 7, 8 and two pairs of links 9, 11.

The means for moving the links relative to the holder or holders 6 and for thereby moving the carriers 1 and 2 relative to the holder or holders comprises a disc cam 13 which is coaxial with the shaft 4 and whose peripheral cam surface 14 is tracked by roller followers 16, 17 on the median portions of the inner links 8 and 9, namely, of those links which are nearer to the shaft 4 and cam 13. The cam 13 is driven at intervals or continuously to turn back and forth as indicated by the double-headed arrow 12. The means for intermittently rotating the cam 13 back and forth to and from a starting position is shown at 13F. The means for biasing the roller followers 16, 17 against the cam face 14 comprises a helical spring 19 whose end portions are secured to suitable posts **19*a*, 19*b* on the other links 7 and 11. The arrow 18 indicates the direction in which the illustrated holder 6 turns about the axis of the shaft 4** when the apparatus is in use.

The carriers 1 and 2 are movable between a first station I where they discharge empty trays and receive filled trays, and a second station II where the contents of filled trays are transferred into the magazine 21. For example, the magazine 21 may constitute an intermediate reservoir of a processing machine, such as a packing machine for plain or filter cigarettes.

FIGS. 2 to 5 illustrate a second apparatus wherein all such parts which are identical with or clearly analogous to corresponding parts of the apparatus of FIG. 1 are denoted by similar reference characters plus 100. One of the main differences between the apparatus of FIG. 1 on the one hand and the apparatus of FIGS. 2 to 5 on the other hand is that the links 107, 108 and 109, 111 of FIGS. 2–5 are respectively parallel to each other.

Figure 2:
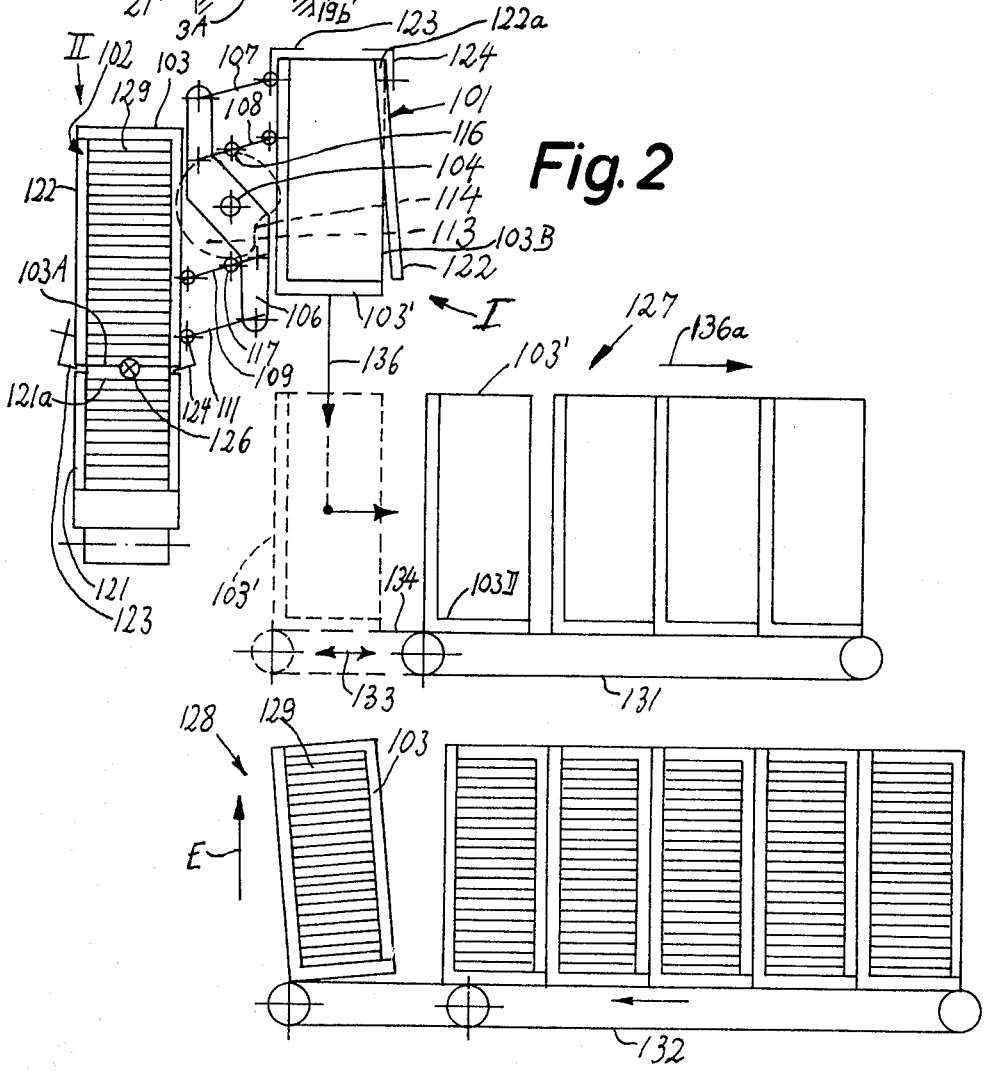
FIG. 2 is a schematic side elevational view of an apparatus which constitutes a slight modification of the apparatus shown in FIG. 1.

FIG. 2 shows that each of the two carriers 101, 102 has a front panel 122 which is pivotable at **122*a* and normally overlies the open front side 103B of a filled tray 103 therein. The panels 122 are pivotable between operative positions (see the carrier 102 of FIG. 2) and inoperative positions (see the carrier 101 of FIG. 2), so that they positively prevent any axial shifting of rod-shaped articles 129 in a filled tray when moved to operative positions but allow for convenient introduction of a filled tray or for convenient removal of an empty tray 103'** when in the inoperative position.

FIG. 2 further shows that the carriers 101 and 102 comprise pivotable lateral brackets 123 and 124 which constitute retainers for the uppermost layers of articles in the filled trays therein so that the contents of a filled tray can be evacuated only when the respective carrier 101 or 102 is turned upside down and the brackets 123, 124 of such inverted carrier are pivoted to retracted positions. This prevents losses of rod-shaped articles during inversion of the carrier 101 or 102. Each of the two carriers 101, 102 can further comprise retaining means or retainers (not specifically shown) which serve to prevent unintentional removal or shifting of a tray 103 in the carrier 101 or 102. Such additional retaining means may constitute or comprise additional brackets pivotally mounted on the two carriers so as to move to operative or retaining positions as soon as the carrier 101 or 102 receives a filled tray 103 at the station I, and to move to releasing or inoperative positions as soon as the carrier 101 or 102 returns a freshly emptied tray 103' to the station I. The just discussed additional retaining means or brackets are provided in the bottom regions of the carriers 101, 102 (the term "bottom regions" is intended to denote those portions of the carriers which constitute the bottom or base portions in upright positions of the carriers).

Still further, FIG. 2 shows a monitoring device 126 which is mounted in the region of the open upper end portion **121*a* of the magazine 121 to detect the presence or absence of rod-shaped articles 129 in the tray 103 whose open top 103A is located above the magazine 121 while the respective carrier 101 and 102 is held in the inverted position. The monitoring device 126 may comprise a photocell having a light source at one side and a photosensitive transducer at the other side of the open upper end portion 121*a* of the magazine 21. The transducer transmits a signal when the contents of an inverted tray on top of the magazine 121** have been transferred into the magazine, i.e., when the light beam issuing from the source can reach the photosensitive surface of the transducer.

The cam 113 is coaxial with the horizontal shaft 104 for the holder 106.

The first station I is located about a device 127 for reception of empty trays 103' and a device 128 for delivery of filled trays 103. Thus, that carrier (101 or 102) which is located at the station I can be relieved of an empty tray 103' which is deposited on a horizontally reciprocable portion 134 of a horizontal bottom conveyor 131 of the device 127, and the carrier which has been relieved of the empty tray can receive a filled tray 103 from the bottom conveyor 132 of the device 128. The rod-shaped articles 129 in the filled trays 103 on the bottom conveyor 132 of the device 128 are assumed to be plain cigarettes or filter cigarettes. The directions in which the portion 134 of the bottom conveyor 131 is reciprocable in parallelism with the bottom walls 103D of the empty trays 103' are indicated by a double-headed arrow 133.

The apparatus of FIGS. 2 to 5 further comprises an elevator which is denoted by an arrow E. The exact construction of this elevator forms no part of the present invention. Its purpose is to lift the foremost filled tray 103 (i.e., the leftmost tray on the bottom conveyor 132 of FIG. 2) into the interior of the carrier 101 or 102 at the station I (after the carrier at the station 101 has been relieved of an empty tray 103'). The elevator E further serves to lower empty trays 103' from the carrier 101 or 102 at the station I. During lowering of an empty try 103' from the carrier 101 or 102 at the station I, the bottom conveyor portion 134 is held in the broken-line position of FIG. 2 so that it can receive the descending empty tray. During lifting of a filled tray 103 from the bottom conveyor 132 toward the interior of the carrier 101 or 102 at the station I, the bottom conveyor portion 134 is moved out of the way (i.e., in a direction to the right, as viewed in FIG. 2).

A known type of an elevator is disclosed, for example, in U.S. Pat. No. 3,703,242 to Marradi.

The operation of the apparatus of FIGS. 2 to 5 is as follows:

FIG. 2 illustrates that a filled tray 103 in the carrier 102 rests on top of the magazine 121. The carrier 102 is inverted and the brackets 123, 124 of the carrier 102 are held in the retracted positions so that the articles 129 which were confined in the tray 103 at the station II are free to descend by gravity and to pile up on top of the articles in the interior of the magazine 121. The rate at which the contents of the tray 103 at the station II are transferred into the magazine 121 depends on the rate at which the articles 129 are processed by the packing machine which includes the magazine 121.

Figure 3:
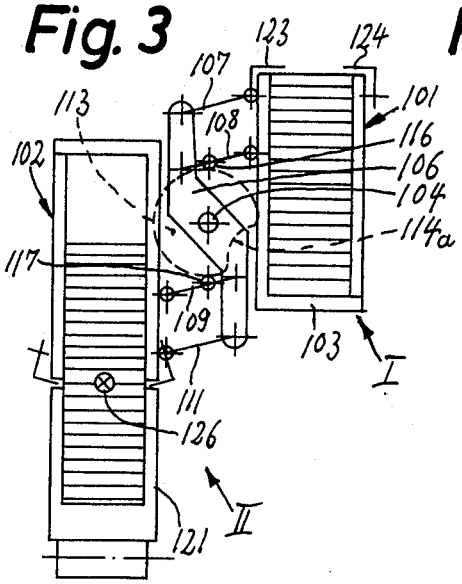
FIG. 3 illustrates a portion of the apparatus of FIG. 2, with the carriers for the trays shown in the positions they assume while a partially filled tray rests on top of the magazine and a filled tray is held in a position of readiness to the magazine.

At the same time (i.e., while the carrier 102 is held in inverted position at the station II), the other carrier 101 is held at the station I and is maintained in upright position. The elevator E lowers an empty tray 103' from the interior of the carrier 101 onto the reciprocable portion 134 of the bottom conveyor 131 (see the arrow 136 in FIG. 2). The upper reaches of the endless flexible elements of the conveyor 131 and its portion 134 are then caused to move in a direction to the right so that the freshly deposited empty tray 103' is moved out of the way (arrow **136*a*). The elevator E is then free to continue its downward movement so that it can engage the leftmost filled tray 103 on the conveyor 132 for transport upwardly and into the carrier 101 at the station I. This is shown in FIG. 3 which further shows that the removal of an empty tray 103' from the carrier 101 at the station I and the insertion of a filled tray 103 into the carrier 101 at the station I take place during evacuation of the contents of the filled tray 103 in the inverted carrier 102** at the station II.

Figure 4:
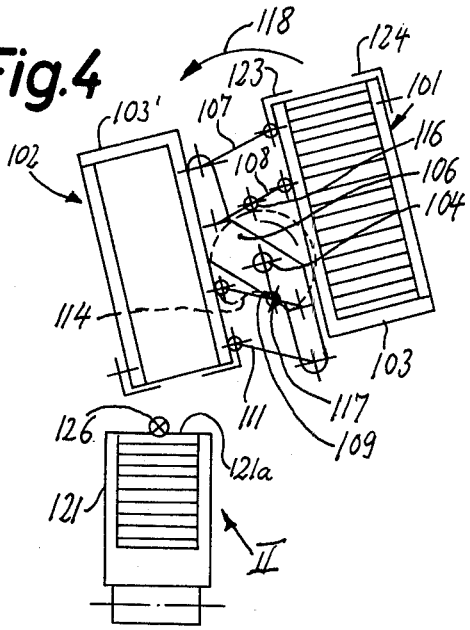
FIG. 4 illustrates the structure of FIG. 3, with an empty tray in the process of being moved away from the open top of the magazine.
Figure 5:
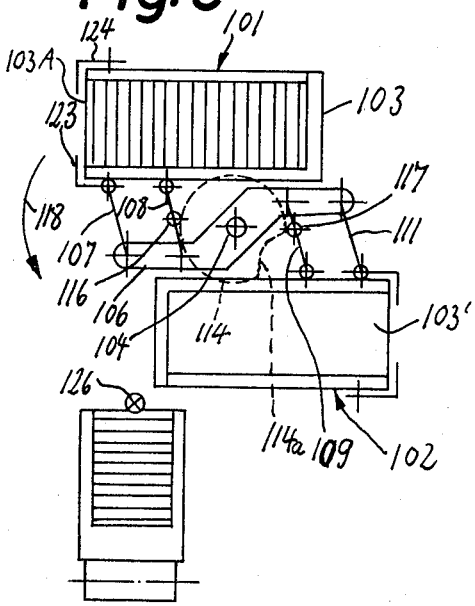
FIG. 5 illustrates the structure of FIG. 4, with the empty tray in a further position and with the filled tray in the process of advancing toward the top of the magazine.
Figure 6:
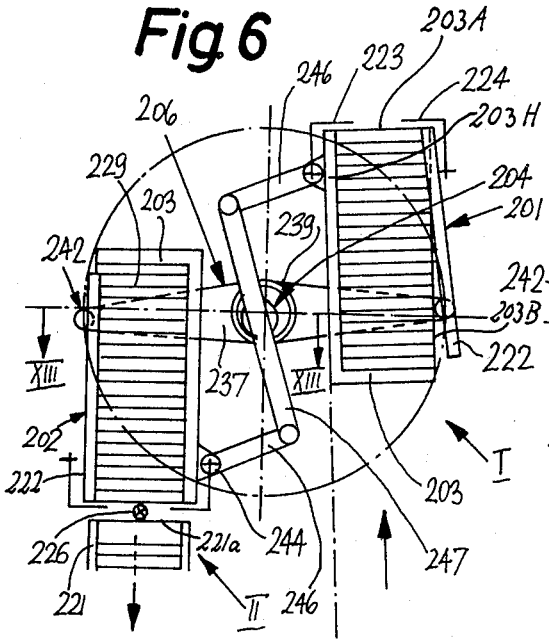
FIG. 6 is a schematic side elevational view of a portion of a third apparatus, showing a filled tray during the last stage of movement toward the top of the magazine.
Figure 7:
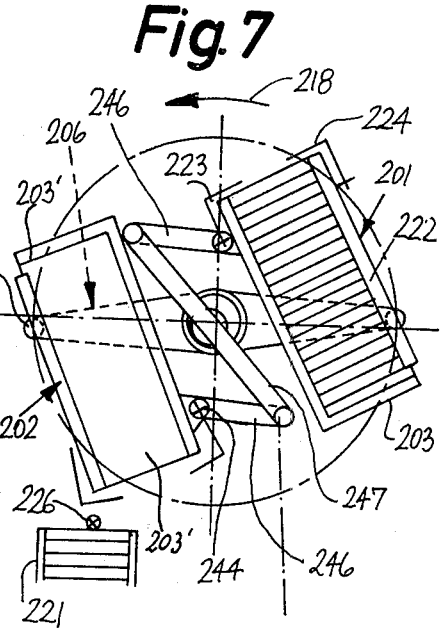
FIG. 7 illustrates the structure of FIG. 6, with the freshly emptied tray in the process of being removed from the top of the magazine.

When the monitoring device 126 detects that the tray 103 in the inverted carrier 102 at the station II has been converted into an empty tray 103', its transducer transmits a signal which initiates the movements shown in FIGS. 4 and 5, i.e., the holder 106 is caused to turn about the axis of the shaft 104 and the links 107, 108, 109, 111 are caused to pivot relative to the carriers 101, 102 and holder 106 to return the carrier 102 to upright position (at the station I) and to invert the carrier 101 on top of the magazine 121 (at the station II).

While the holder 106 rotates about the axis of the horizontal shaft 104 (arrow 118), the disc cam 113 is caused to turn in the opposite direction (i.e., the holder 106 rotates counterclockwise and the cam 113 turns in a clockwise direction). For example, the shaft 104 can rotate the holder 106 by way of a transmission which derives motion from an electric or other suitable motor, not shown, and the cam 113 can derive motion from a suitable crank drive, not shown. The two movements (namely, rotation of the holder 106 in the direction which is indicated by the arrow 118 and rotation of the disc cam 113 in the opposite direction) are synchronized in such a way that, when the roller follower 117 enters the recess **114*a* of the cam face 114 on the cam 113, the carrier 102 with the freshly emptied tray 103' therein is lifted above and away from the open upper end portion 121*a* of the magazine 121 (see FIG. 4) prior to inversion (i.e., movement to upright position) and simultaneous movement to the station I. Lifting of the carrier 102 above and away from the magazine 121 insures that the inverted carrier 102 and/or the empty tray 103' therein does not strike against the upper end portion 121*a* during return movement to upright position and simultaneous transport back to the station I. At least the major part of inversion of the carrier 102 during movement from the station II to the station I takes place simultaneously with such movement of the carrier 102 to the station I. The links 107, 108 and 109, 111 take care of movements of the carriers 101 and 102 relative to the holder 106 during movement of the carrier 102 from the station II to the station I and during simultaneous movement of the carrier 101** from the station I to the station II.

The cam 113 is thereupon caused to turn in the opposite direction, namely, in a counterclockwise direction, as viewed in FIGS. 4 and 5, so that it reassumes its starting position whereby the roller follower 117 leaves the recess **114*a* (see FIG. 5). As shown in FIG. 5, this takes place when the holder 101 (which contains a filled tray 103) has already arrived at the station II or is in the process of arriving at the station II. Inversion of the carrier 101 is then continued (simultaneously with return movement of the carrier 102 to upright position) so that the top 103A of the filled tray 103 in the carrier 101 is located in immediate proximity of the upper end portion 121*a* of the magazine 121. The empty tray 103' in the carrier 102 has arrived at the station I and is ready to be removed by the elevator E as soon as the retaining bracket or brackets at the lower end of the carrier 102 at the station I are moved to retracted positions in order to release the empty tray 103' for downward movement with the elevator. Such empty tray 103' is transferred onto the conveyor portion 134 which thereupon moves in a direction to the right, as viewed in FIG. 2, and the elevator E descends to accept a filled tray 103 from the conveyor 132 for transport of such filled tray into the carrier 102** at the station I.

The spring or other suitable biasing means which urges the roller followers 116, 117 on the inner levers 108, 109 against the peripheral surface 114 of the cam 113 is not shown in FIGS. 2 to 5.

An important advantage of the improved apparatus is that the path along which the carriers 101, 102 orbit about the axis of the shaft 104 is not a true cylindrical path because the links 107, 108 and 109, 111 cause the carriers to pivot relative to the holder 106 while the latter moves one carrier from the station I to the station II simultaneously with movement of the other carrier from the station II to the station I. In other words, the carriers 101, 102 orbit about the fixed axis of the shaft 104 and simultaneously pivot about mobile axes defined by the pins which connect the links 107, 108 and 109, 111 to the respective carriers as well as to the holder 106. The just described movements of the carriers 101, 102 relative to the holder 106 (while the latter turns about the axis of the shaft 104) enable a filled tray 103 to move downwardly during the last stage of its transport to the station II (so that the open top 103A of such tray comes to rest on the upper end portion **121*a* of the magazine 121), and that an empty tray 103' rises above and moves away from the upper end portion 121*a* during the initial stage of movement of the respective carrier 101 or 102 from the station II. Analogously, each carrier which stores a tray 103' and arrives at the station I is held in an optimum (e.g., non-inverted upright) position for removal of the empty tray 103' and insertion of a filled tray 103** before such carrier begins to leave the station I.

The provision of pairs of links for each of the carriers 101, 102 contributes to compactness of the apparatus.

FIGS. 6 through 14 show a third embodiment of the improved apparatus wherein all such component parts which are identical with or clearly analogous to those of the apparatus of FIGS. 2 to 5 are denoted by similar reference characters plus 100. The apparatus of FIGS. 6 through 14 also comprises two carriers 201, 202 for reception of trays, each of which is open at the top 203A and at its front side 203B. The carriers 201, 202 are articulately connected to one or two holders 206 which are turnable about the axis of a horizontal shaft 204. The station I serves for transfer of empty trays 203' from the carrier 201 or 202 and for insertion of filled trays 203, and the station II is located above the upper end portion 221*a* of a magazine 221. The reference character 226 again denotes an photoelectronic device which monitors the contents of the tray at the station II. The carriers 201, 202 have pivotable panels 222 which serve the same purpose as the panels 122, pivotable brackets 223, 224 which serve the same purpose as the brackets 123, 124, and additional brackets (not shown) which serve to releasably retain the trays in the carriers 201, 202 while the carriers are remote from the station I as well as at the station I prior to removal of an empty tray 203' at the station I or prior to complete introduction of a filled tray 203 into the carrier at the station I. The additional brackets are pivotable at right angles to the plane of FIG. 6 so as to be movable out of the way when a tray is to be inserted into or removed from the carrier at the station I.

The holder 206 is directly coupled to the carriers 201 and 202. To this end, the holder 206 comprises two pairs of arms 237, 238 and 239, 241 (see FIG. 13). The arms 237, 238 flank the carrier 202 (i.e., this carrier is disposed between such arms) and are connected thereto at that side of the carrier 202 which faces away from the shaft 204. The carrier 202 has eyelets 243 having holes which register with the holes in the respective end portions of the arms 237, 238 for reception of pivot pins 242 so that the carrier 202 can turn (to a limited extent) with reference to the arms 237, 238. The mounting of the carrier 201 on the arms 239, 241 is similar, i.e., that side of the carrier 201 (not shown in FIG. 13) which faces away from the shaft 204 is formed with eyelets in register with the end portions of the arms 239, 241 for reception of pivot pins which allow for limited angular movements of the carrier 201 relative to such arms.

Figure 13:
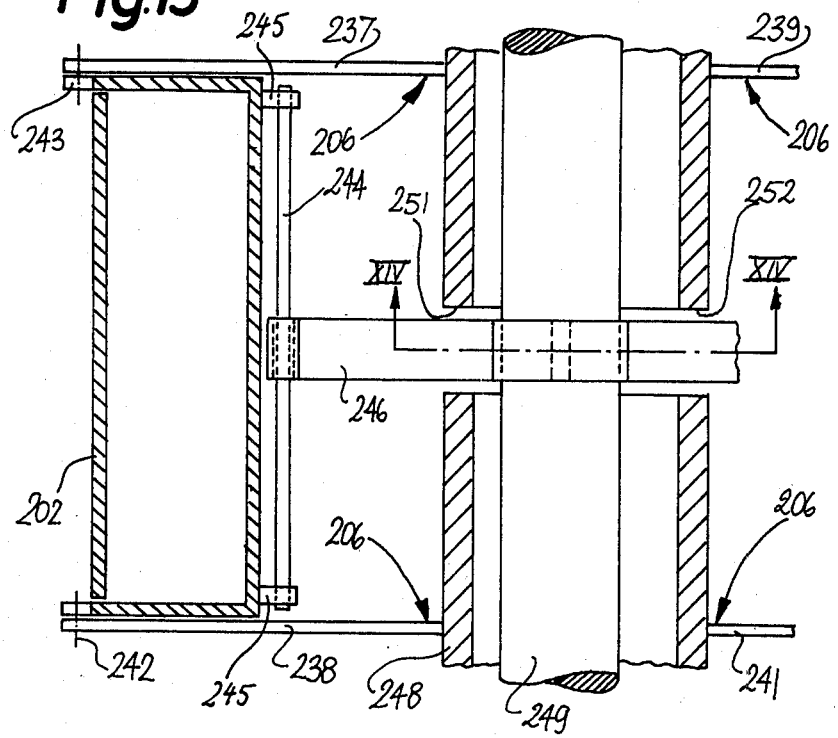
FIG. 13 is an enlarged sectional view as seen in the direction of arrows from the line XIII—XIII of FIG. 6.
Figure 14:
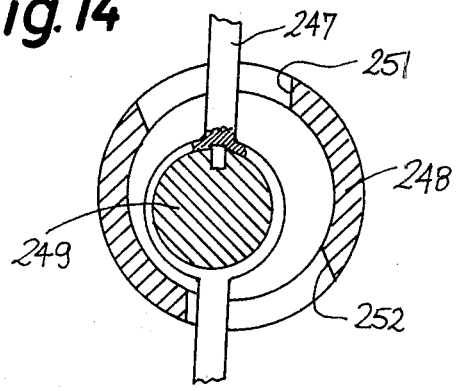
FIG. 14 is an enlarged sectional view as seen in the direction of arrows from the line XIV—XIV of FIG. 13.

Those sides of the carriers 201, 202 which face the shaft 204 carry bearing members 245 for pintles 244 (see the pintle 244 of FIG. 13 which is connected to the carrier 202). The pintles 244 are articulately connected with links 246 which, in turn, are articulately connected to the respective ends of a two-armed coupling member or lever 247. The lever 247 is mounted on a shaft 249 (see FIGS. 13 and 14) which is eccentrically installed in a hollow cylinder 248 forming part of the shaft 204 for the carrier 206. The hollow cylinder 248 has cutouts or recesses 251, 252 (FIGS. 13 and 14) to allow for requisite pivotal movements of the coupling member or lever 247 which carries the links 246.

Figures 10, 11, 12:
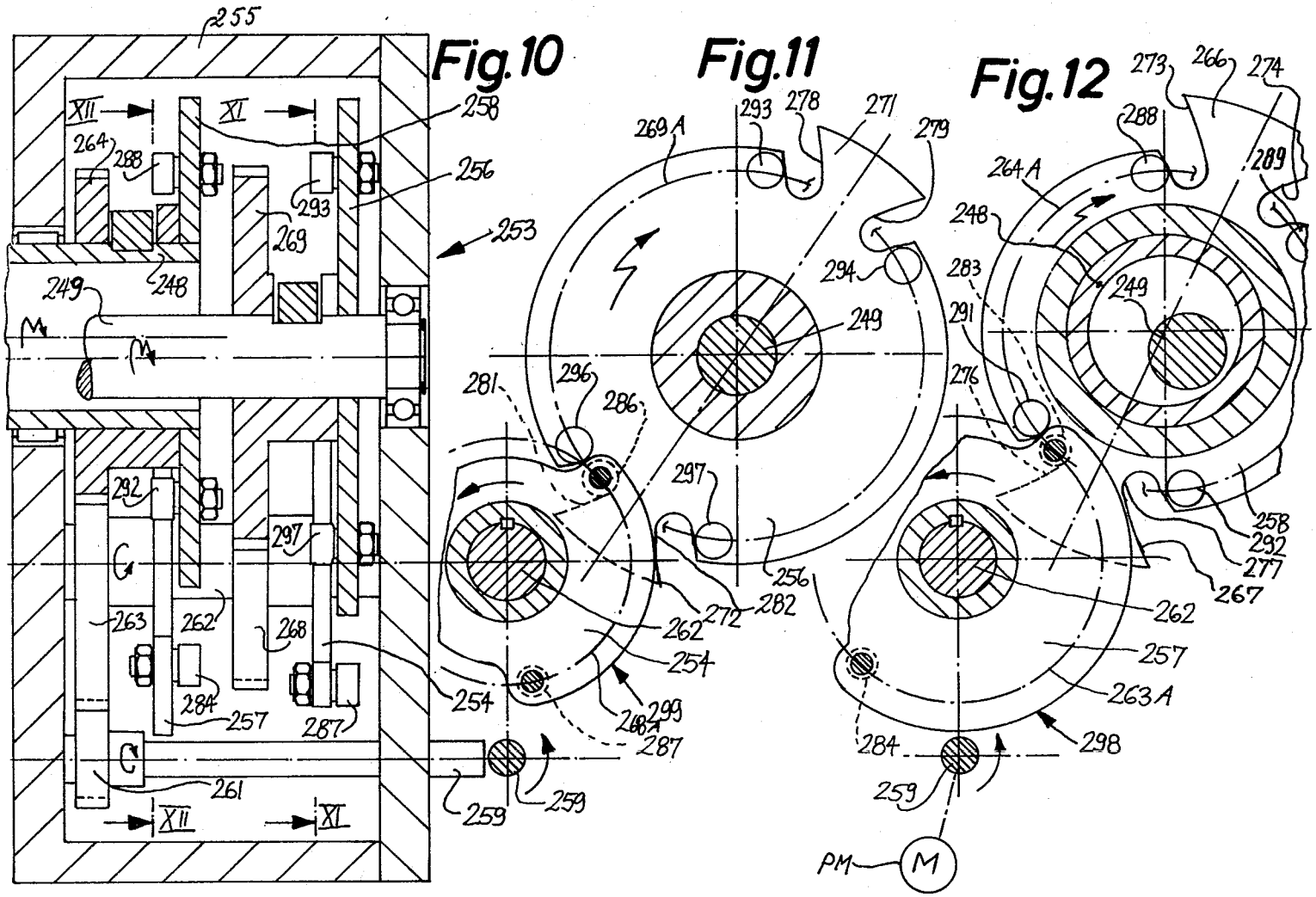
FIG. 10 is a transverse vertical sectional view of the drive means for the holder which supports the carriers for the trays shown in FIGS. 6 through 9.
FIG. 11 is a fragmentary sectional view as seen in the direction of arrows from the line XI—XI of FIG. 10.
FIG. 12 is a fragmentary sectional view as seen in the direction of arrows from the line XII—XII of FIG. 10.

The drive means for the shafts 204 and 249 comprises a specially designed transmission 253 the details of which are shown in FIGS. 10 to 12. The transmission 253 comprises a first continuously rotatable disc cam 254 and a first intermittently rotatable star wheel 256 for transmitting motion to the shaft 249, and a second continuously rotatable disc cam 257 as well as a second intermittently rotatable star wheel 258 for transmitting motion to the hollow cylinder 248 of the shaft 204. The transmission 253 further comprises an input shaft 259 which receives torque from a prime mover PM (e.g., an electric motor) and carries a gear 261 in mesh with a gear 263 on an intermediate shaft 262. The parts of the transmission 253 are installed in a housing or case 255. The gear 263 on the intermediate shaft 262 meshes with a gear 264 on the hollow cylinder 248 of the shaft 204. The gears 263 and 264 are represented in FIG. 12 by their respective pitch circles 263A, 264A.

The teeth of the gear 264 are interrupted or missing in the region of two teeth 266 and 267 of the associated star wheel 258. The intermediate shaft 262 carries a further gear 268 which meshes with a gear 269 on the shaft 249. The pitch circles of the gears 268 and 269 are indicated in FIG. 11 by the respective pitch circles 268A and 269A. The teeth of the gear 269 are missing in the region of two teeth 271 and 272 of the star wheel 256. As shown in FIGS. 11 and 12, the teeth 266, 267 and 271, 272 of the star wheels 258 and 256 are respectively flanked by recesses 273–274, 276–277 and 278–279, 281–282 of the respective star wheels. These recesses can respectively receive rolls 283, 284 and 286, 287 of disc cams 257 and 254. The star wheels 258 and 256 respectively carry roller followers 288, 289, 291, 292 and 293, 294, 296, 297 which respectively track the faces of the cams 257 and 254. The peripheral surfaces of the disc cams 257, 254 are respectively provided with blocking lobes 298 and 299.

Figure 8:
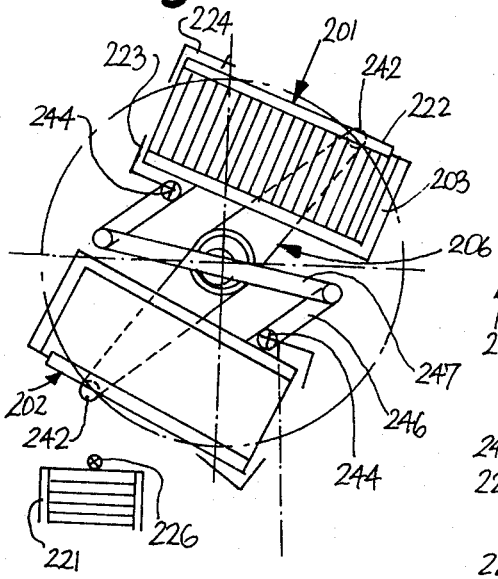
FIG. 8 illustrates a further phase of movement of the empty tray of FIG. 7 away from the magazine.
Figure 9:
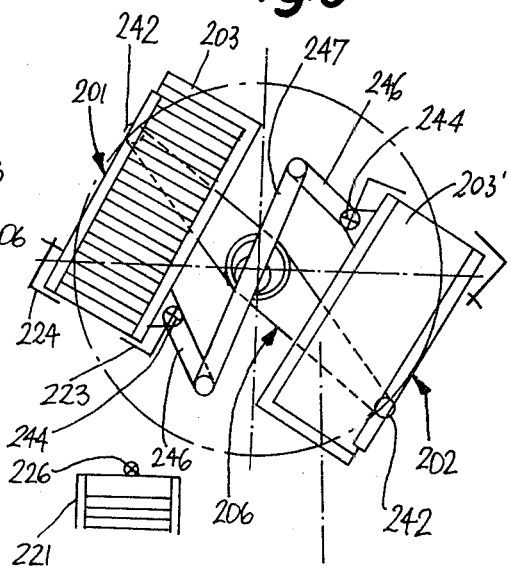
FIG. 9 illustrates still another phase of movement of the empty tray of FIGS. 7 and 8 away from the magazine.

The operation of the apparatus which is illustrated in FIGS. 6 through 14 is as follows:

During the major part of angular movement of the holder 206 in a manner as shown in FIGS. 8 and 9, the gear 263 meshes with the gear 264 and the gear 268 meshes with the gear 269. The motor PM continuously drives the input shaft 259 whereby the hollow cylinder 248 and the shaft 249 cause a continuous angular movement of the carriers 201 and 202 until the carriers 201 and 202 assume positions which are close to the positions shown in FIG. 6. At such time, the component parts of the transmission 253 assume the positions which are shown in FIGS. 11 and 12. The following part of the description of operation of the apparatus of FIGS. 6 through 14 will be made with reference to movements of various components from the positions shown in FIGS. 11 and 12. It will be noted that, when the components of the transmission 253 assume the positions which are illustrated in FIGS. 11 and 12, the gear 263 does not mesh with the gear 264 and the gear 268 is out of mesh with the gear 269. This is due to the fact that the tooth-free portions of the gears 264 and 269 are immediately adjacent to the gears 263 and 268, respectively. Therefore, the hollow cylinder 248 is driven by the disc cam 257 which cooperates with the star wheel 258, and the shaft 249 is driven by the disc cam 254 which cooperates with the star wheel 256. As shown in FIGS. 11 and 12, the roller follower 296 receives motion from the disc cam 254, and the roller follower 291 receives motion from the disc cam 257. The roller followers 296 and 291 respectively engage the lobes 299 and 298 to thereby allow for progressive deceleration of the star wheels 256 and 258. In this manner, the carrier 202 is moved to an exactly vertical position, together with the filled tray 203 therein (see FIG. 6) not later than when the just mentioned filled tray reaches the upper end portion 221*a* of and comes to rest on the magazine 221. Pivotal movement of the holder 206 and of the lever 247 is interrupted at a predetermined moment because the roller followers 297 and 292 of the star wheels 256 and 258 respectively engage the lobes 299 and 298 so that, when the prime mover PM is arrested, the relatively small further angular movement of the output element of the prime mover PM does not and cannot cause any further angular movements of the holder 206 and/or lever 247. When the contents of the filled tray 203 at the station II are transferred into the magazine 221, the photocell 226 transmits a signal which initiates return movement of the carrier 202 with the empty tray 203' therein back to the station I. At the same time, the carrier 201 (which, in the meantime, has been relieved of an empty tray 203' and has received a filled tray 203) is transferred from the station I to the station II. The turning movement of the shaft 249 under the action of the disc cam 254 and star wheel 256 is slightly ahead of movements of the corresponding components (cam) 257 and (star wheel) 258 for the hollow cylinder 248. Therefore, the lever 247 is pivoted relative to the holder 206 during a first phase. This is achieved in that the roll 287 of the disc cam 254 engages the flank of the tooth 272 on the corresponding star wheel 256 and thereby enters the recess 282. At the same time, the roller follower 297 of the star wheel 256 rolls off the lobe 299 of the disc cam 254 so that the star wheel 256 is accelerated together with the shaft 249. In this manner, the links 246 of FIG. 6 pivot the carrier 202 about the pivot pin 242 on the arm 237 in order to increase the distance between the empty tray 203' and the upper end portion 221*a* of the magazine 221 before the holder 206 begins to turn under the action of the components which are shown in FIG. 12 whereby the angular movement of the holder 206 overlaps the angular movement of the carrier 202. Once the rolls 287 and 284 leave the corresponding recesses 282 and 277 of the star wheels 256 and 258, the teeth of the gears 268, 269 and 263, 264 again take over the initiation of rotation of the lever 247 and holder 206 until shortly before the carrier 202 reaches the station I so that the empty tray 203' therein can be removed and replaced with a filled tray 203.

The means for pivoting the holder 206 and/or the lever 247 can be simplified in a number of ways without departing from the spirit of the invention. For example, the transmission 253 can be replaced with a relatively simple and less expensive rack and pinion drive the exact construction of which forms no part of the present invention.

The apparatus of FIGS. 6 to 14 exhibits the advantage that the components of the drive means for the shafts 204, 249 (i.e., the transmission 253) can be readily encapsulated (in the casing 255). It will be noted that, in contrast to the embodiment of FIG. 1 or the embodiment of FIGS. 2–5, the apparatus of FIGS. 6–14 employs links 246 which articulately connect the inner sides of the carriers 201, 202 to the coupling member or lever 247 rather than to the holder 206. The illustrated construction of drive means for the shaft 249 and hollow cylinder 248 also contributes to compactness of the transmission 253.

Eccentricity of the shaft 249 relative to the hollow cylinder 248 is desirable and advantageous because this insures that the carrier 201 or 202 at the station I assumes a slightly inclined position (see FIG. 6) so as to contribute to convenience of removal of empty trays 203' and of insertion of filled trays 203. Such slightly inclined position insures that the articles 229 in a filled tray 203 at the station I tend to abut against the rear wall 203H of such tray so that the articles of the stack in the tray 203 at the station I are even less likely to change their orientation.

The cams 254, 257 are driven continuously, and the followers of the associated star wheels 256, 258 cause the respective star wheels to rotate intermittently.

The manner in which the carrier 201 or 202 at the station II is relieved of empty trays 203' and receives filled trays 203 is preferably the same as shown in FIG. 2.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

We claim:

1. Apparatus for transporting filled trays from a first station to a second station at which a filled tray is located on top of a magazine and its contents are transferred into such magazine, and for thereupon transporting the thus obtained empty trays from said second station back to said first station, comprising holder means turnable about a substantially horizontal axis; first and second carriers turnable with said holder means and each arranged to temporarily store a filled tray or an empty tray; means for turning said holder means about said axis to thereby invert that one of said carriers which moves with a filled tray therein from said first to said second station and to simultaneously return to non-inverted position the other carrier which moves with an empty tray therein back to said first station; and means for pivoting said carriers relative to said holder means while said holder means turns to move the carriers between said stations, said pivoting means including means for lowering an inverted carrier with a filled tray therein on top of said magazine during the last stage of movement to said second station and for lifting such carrier with an empty tray therein off the top of the magazine during the initial stage of movement from said second station.

2. The apparatus of claim 1, wherein said holder means includes first and second portions disposed at the opposite sides of said axis and said pivoting means further comprises link means, said link means including first and second link means pivotally connecting said first and second carriers to the respective portions of said holder means, each of said link means comprising a plurality of links.

3. The apparatus of claim 2, wherein the links of said first and second link means are respectively parallel to each other.

4. The apparatus of claim 2, wherein said pivoting means further comprises rotary cam means and follower means provided on at least one of said link means and tracking said cam means.

5. The apparatus of claim 4, wherein the links of each of said link means include a first link nearer to and a second link more distant from said cam means, said follower means comprising a discrete follower on each of said first links.

6. The apparatus of claim 5, further comprising means for intermittently rotating said cam means.

7. The apparatus of claim 6, wherein said rotating means includes means for rotating said cam means back and forth from and to a starting position.

8. The apparatus of claim 4, further comprising means for biasing said follower means against said cam means.

9. The apparatus of claim 8, wherein said cam means includes a disc cam having a peripheral surface and said biasing means urges said follower means against said peripheral surface.

10. The apparatus of claim 8, wherein said biasing means includes resilient means connecting said first link means with said second link means.

11. The apparatus of claim 4, wherein said cam means is coaxial with said holder means.

12. The apparatus of claim 1, wherein said holder means includes first and second portions disposed at the opposite sides of said axis and each of said carriers includes an outer side remote from and an inner side nearer to said axis, and further comprising pivot means connecting said first and second portions to the respective carriers in the region of the outer sides of such carriers.

13. The apparatus of claim 12, wherein said pivot means further comprises link means and said link means includes first and second links articulately connected with said first and second carriers in the regions of the inner sides of the respective carriers and a coupling member articulately connecting said links to each other.

14. The apparatus of claim 13, wherein said coupling member includes a lever having first and second arms pivotally connected to the respective links.

15. The apparatus of claim 14, wherein said turning means includes a first substantially horizontal shaft including a hollow cylinder arranged to transmit torque to said holder means and a second substantially horizontal shaft disposed in said cylinder and arranged to transmit torque to said lever.

16. The apparatus of claim 15, wherein said cylinder has recesses to allow angular movement of said lever with respect to said first shaft.

17. The apparatus of claim 15, wherein said second shaft is eccentric with respect to said cylinder.

18. The apparatus of claim 15, wherein said turning means further comprises drive means for rotating said cylinder and said drive means includes a rotary cam, means for rotating said cam, a star wheel coaxial with said cylinder, and means for rotating said star wheel in response to rotation of said cam.

19. The apparatus of claim 18, wherein said means for rotating said cam includes a device for continuously rotating said cam and said means for rotating said star wheel includes means for intermittently rotating said star wheel in response to continuous rotation of said cam.

20. The apparatus of claim 18, wherein said pivoting means further comprises drive means for rotating said second shaft and said last mentioned drive means includes a second rotary cam, means for rotating said second cam, a second star wheel coaxial with said second shaft, and means for rotating said second star wheel in response to rotation of said second cam.

21. The apparatus of claim 20, wherein said means for rotating said second cam includes a device for continuously rotating said second cam and said means for rotating said second star wheel includes means for intermittently rotating said second star wheel in response to continuous rotation of said second cam.

22. The apparatus of claim 1, further comprising a device for reception of an empty tray from the carrier which arrives at said first station and a device for delivery of a filled tray to the carrier at said first station.

23. The apparatus of claim 22, wherein one of said devices is disposed at a level above the other of said devices.

24. The apparatus of claim 23, wherein said devices are disposed at a level below said first station.

25. The apparatus of claim 23, wherein said one device includes a portion which is movable between a carrier at said first station and the other of said devices.

26. The apparatus of claim 25, wherein said one device is said first mentioned device and further comprising means for moving trays between a carrier at said first station and said devices.

* * * * *